United States Patent [19]

Heibel

[11] 4,371,317

[45] Feb. 1, 1983

[54] HYDRAULIC SYSTEMS

[75] Inventor: Helmut Heibel, Moschheim, Fed. Rep. of Germany

[73] Assignee: Lucas Industries Limited, Birmingham, England

[21] Appl. No.: 232,687

[22] Filed: Feb. 9, 1981

[30] Foreign Application Priority Data

Feb. 16, 1980 [GB] United Kingdom ..... 8005303

[51] Int. Cl.[3] ..... F04B 49/08

[52] U.S. Cl. ..... 417/298; 417/307

[58] Field of Search ..... 417/296, 298, 307

[56] References Cited

U.S. PATENT DOCUMENTS

| | | | |
|---|---|---|---|
| 2,387,117 | 10/1945 | Buehler, Jr. | 417/298 |
| 2,684,631 | 7/1954 | Anthony et al. | 417/307 |
| 3,316,926 | 5/1967 | Worth | 417/298 |
| 3,834,837 | 9/1974 | Nickell | 417/298 |

FOREIGN PATENT DOCUMENTS

| | | | |
|---|---|---|---|
| 2359291 | 2/1978 | France | 417/298 |
| 2447474 | 9/1980 | France | 417/298 |

*Primary Examiner*—Henry C. Yuen

*Attorney, Agent, or Firm*—Scrivener, Clarke, Scrivener and Johnson

[57] ABSTRACT

In an hydraulic system an unloader valve is located in a line between a pump and an hydraulic accumulator. The unloader valve is operative to prevent the accumulator from being overcharged and to allow the pump to re-charge the accumulator should the pressure stored therein fall below a desired minimum value. The unloader valve incorporates a control valve comprising a spool, and a pressure responsive slave which is operated by fluid pressure under the control of the control valve. A spring acts to bias the spool into a first position against pressure in a control chamber into which fluid is pumped through a first one-way valve. A second valve in series with the first valve is located between the first valve and an exhaust port for connection to a tank for fluid. The slave comprises inner and outer concentric piston parts which are relatively movable axially and of which the inner part is adapted to open the valve to unload the pump.

6 Claims, 5 Drawing Figures

HYDRAULIC SYSTEMS

This invention relates to improvements in hydraulic systems of the kind in which an hydraulic accumulator is charged with hydraulic fluid under pressure by means of an hydraulic pump which draws hydraulic fluid from a tank, and an unloader valve disposed in a supply line between the pump and the accumulator is operative to prevent the accumulator from being overcharged and to allow the pump to re-charge the accumulator should the pressure stored therein fall below a desired minimum value. Our invention is particularly concerned with improvements in unloader valves for hydraulic systems of the kind set forth.

Where used herein the term "hydraulic accumulator" is intended to include any pressure chamber in which hydraulic fluid is stored at high pressure. For example, such a pressure chamber may comprise the pressure chamber of an hydraulic suspension strut.

In our GB patent application No. 2037016A we have disclosed an hydraulic system of the kind set forth in which the unloader valve incorporates a control valve, and a pressure responsive slave which is operated by fluid pressure under the control of the control valve, the control valve comprising a valve member which is movable between a first position in which the accumulator is isolated from the slave so that pump pressure is supplied to the accumulator, and a second position in which fluid pressure from the accumulator or the pump can act on the slave to render the slave operative to unload the pump, and spring means for biassing the valve member into the first position against the control pressure which is present in a control chamber into which fluid is pumped through a first one-way valve, a second valve being connected between the inlet of the first one-way valve and an exhaust port connected to the tank, the second valve being opened by the slave at a cut-out point so that the pump output is returned directly to the tank, and the slave comprising a one-piece piston including a extension of reduced diameter engageable with the valve member of the second valve to urge it away from a complementary seating at the cut-out point.

Since the slave of our GB patent application No. 2037016A comprises a one-piece piston, the volume of the fluid required to advance the piston in its bore in order to open the second valve is equal to the area of the piston multiplied by its stroke. When the accumulator is comparatively small, such a volume of fluid can represent a significant proportion of the capacity of the accumulator, causing the pressure of the fluid which remains in the accumulator to fall to a level significantly below the nominal cut-out pressure. This reduces the effective operating range of the unloader valve.

The area of the piston is governed by the magnitude of the force acting to close the second valve and which has to be overcome. The stroke of the piston cannot be reduced otherwise the free flow of fluid from and to the tank with the unloader valve in the unladen condition would be impeded.

According to our invention in an hydraulic system of the kind set forth the unloader valve incorporates a control valve, and a pressure responsive slave which is operated by fluid pressure under the control of the control valve, the control valve comprising a control valve member which is movable between a first position in which the accumulator is isolated from the slave so that pump pressure is supplied to the accumulator, and a second position in which fluid pressure from the accumulator or the pump can act on the slave to render the slave operative to unload the pump, and spring means for biassing the control valve member into the first position against the control pressure which is present in a control chamber into which fluid is pumped through a first one-way valve, a second valve being connected between the inlet of the first one-way valve and an exhaust port connected to the tank, the second valve being opened by the slave at a cut-out point so that the pump output is returned directly to the tank, and the slave comprising a piston assembly comprising inner and outer concentric piston parts which are relatively movable axially and of which the inner part is engageable with a valve member of the second valve to urge it away from a complementary seating at the cut-out point and the outer part is engageable with the inner part in a direction to open the second valve, in combination with a stop for arresting movement of the outer piston part in a direction towards the second valve after the valve member has been moved away from the seating, whereafter the inner piston part is movable relative to the outer piston part to urge the valve member further away from the seating.

Initially, therefore, the pressure from the accumulator acts over the full area of the slave, namely the total area of the inner and outer piston parts, to develop a substantial force which is necessary to urge the valve member away from the seating. The pressure differential acting across the valve member then decays so that a smaller force comprising the pressure from the accumulator acting over the area of the inner piston part is sufficient to open fully the second valve.

It follows therefore that the volume of fluid necessary to open the second valve is conserved since, after the valve member is unseated, the volume of fluid required to complete the opening movement is equal to the area of the inner piston part multiplied by its stroke.

One embodiment of our invention is illustrated in the accompanying drawings in which.

Figure 1:
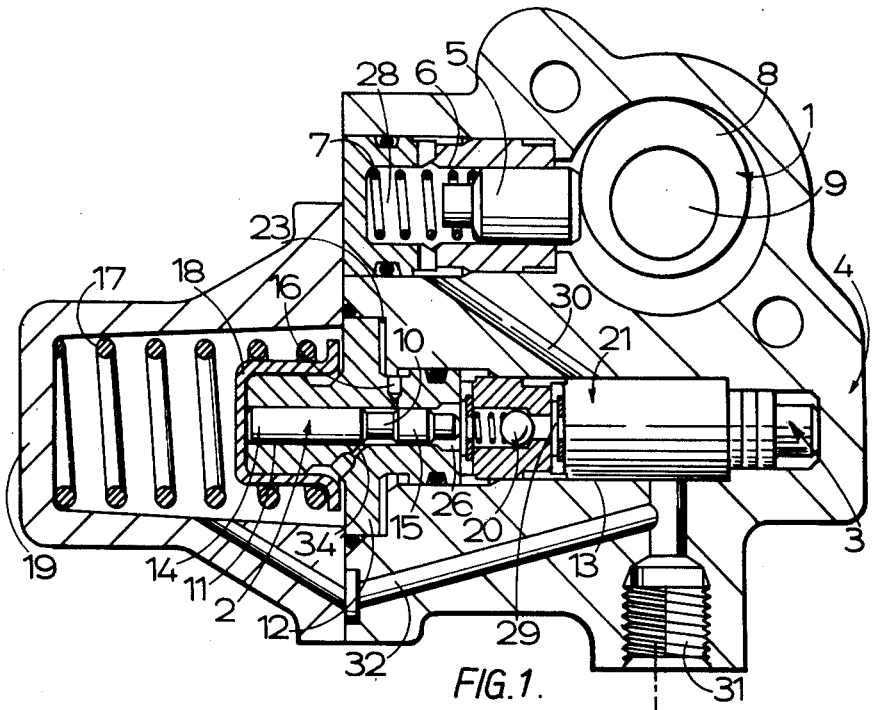
FIG. 1 is a longitudinal section through a combined unloader valve and pump assembly.

In the combined unloader valve and pump assembly illustrated in the accompanying drawings a pump 1, a control valve 2, and a pressure responsive slave 3 are incorporated within a common housing 4.

The pump 1 comprises a plunger 5 which is reciprocated in a bore 6 in the housing 4 against the loading in a spring 7 by means of an eccentric cam 8 which is mounted on a transverse shaft 9, conveniently driven by the prime mover of the vehicle.

The control valve 2 comprises a spool 10 working in a bore 11 in a closure member 12 for the open end of a blind bore 13 in the housing 4 and which is parallel to the bore 6. The spool 10 comprises a first land 14 of substantial length which terminates at the outer end of the spool, and a second land 15 which is spaced from the first. The second land 15 is disposed on the inner side of a restricted orifice 16 in the wall of the closure member 12 when the spool 10 is urged into a first position substantially in alignment with the outer end of the closure member 12 by means of a single spring 17. The inner end of the spring 17 acts on the spool 10 through an abutment 18 of top-hat outline and at its outer end abuts against a sealed end cap 19.

The bore 13 is of stepped outline. A portion of the bore 13 which is of greater area accommodates a pair of spring-loaded one-way valves 20 and 21 which are arranged in series and open and close in corresponding directions, and the pressure responsive slave 3 comprises a piston assembly which works in the inner end portion of the bore 13 which is of smaller area, and is returned by a spring 22 to a stop in the housing 4. The piston assembly 3 comprises inner and outer concentric piston parts 35 and 36 of which the outer part 36 works in the inner portion of the bore 13 and the inner part 35 works through a bore 37 in the outer part 36. An annular seal 38 provides a seal between the outer part 36 and the bore 13, and between the outer part 36 and the inner part 35.

A radial flange 39 on the end of the inner part 35 adjacent to the one-way valve 21 is acted upon by the return spring 22 to urge the inner part 35 against the stop in the housing 4, and the flange 39 acts on the outer part 36 to urge it into an equivalent retracted position in which the outer part 36 is spaced by a predetermined distance from a radial stop 40 constituted by a casing 41 for the one-way valve 21. The free inner end of the inner part 35 comprises a probe 42 of reduced diameter for urging the valve member 43 of the one-way valve 21 away from its seating 44.

Figure 3:
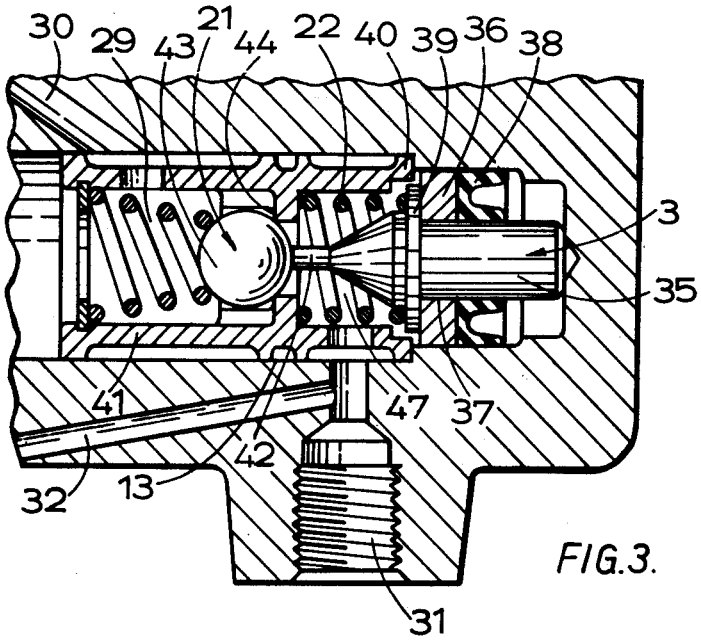
FIG. 3 is a section on an enlarged scale of the second valve incorporated in the assembly of FIG. 1.

In the retracted position shown in FIG. 3 of the drawings the distance between the stop 40 and the outer part 36 is slightly greater than the distance between the probe 42 and the valve member 43.

A chamber 23 defined between the closure member 12 and the wall of the bore 13 and into which the orifice 16 issues, is connected through longitudinal and transverse passages 24 and 25 into the end of the bore 13 adjacent to its closed end so that the piston assembly 3 at that end is exposed to pressure in the chamber 23.

A control chamber 26 defined between the one-way valve 20 and the closure member 12 is adapted to be connected to an accumulator 45 from an outlet port 27, and the inner end of the spool 10 is subjected to pressure in that chamber 26.

A pump chamber 28 at the end of the bore 6 which is remote from the cam 8 is connected to a space 29 between the two one-way valves 20 and 21 through a passage 30.

Finally, an exhaust port 31 for connection to a tank 46 for hydraulic fluid is connected to a chamber 47 between the piston assembly 3 and the one-way valve 21, and is connected to the interior of the end cap 19 through an internal passage 32.

Figure 2:
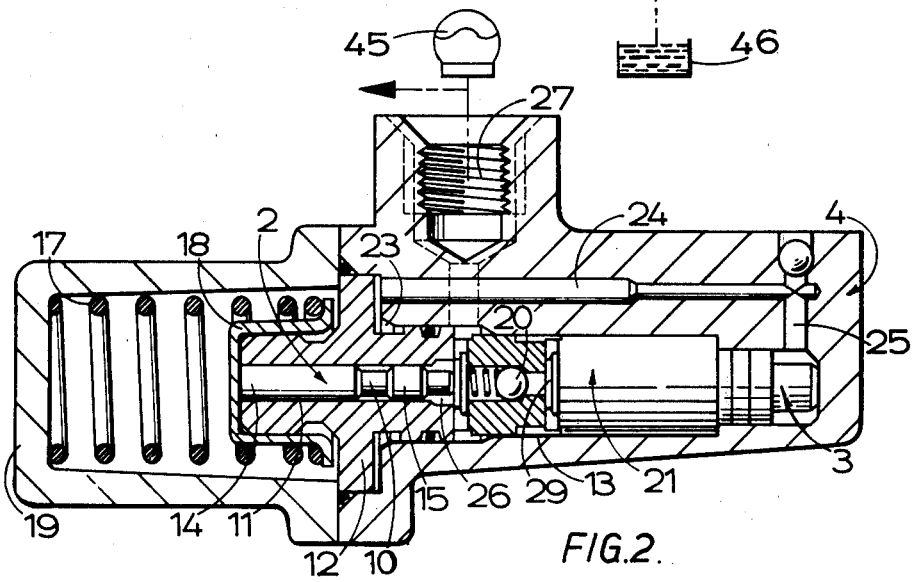
FIG. 2 is a longitudinal section through the assembly of FIG. 1 but displaced by 90°.

In a normal inoperative and depressurised position as shown in FIGS. 1 to 3 of the drawings, both one-way valves 20 and 21 are closed and the spool 10 is in its first position with the land 15 isolating the control chamber 26 from the orifice 16. In this position the chamber 23 is connected to the interior of the end cap 19 through a passage 34 in the end closure 12 so that the chamber 23 is at atmospheric tank pressure.

When the pump is operated the suction stroke of the piston 5, under the effect of the loading of the spring 7, draws fluid from the tank 46 and into the bore 6 through the chamber 47, the one-way valve 21, the space 29, and the passage 30 with the one-way valve 20 remaining closed. The delivery stroke of the piston 5 by the cam 8 pumps fluid back through the passage 30, through the valve 20 and into the accumulator 45 through the control chamber 26.

The pressure in the accumulator 45 increases until the equal pressure in the control chamber, acting on the inner end of the spool 10, is sufficient at a cut-in point, say 1000 p.s.i., to move the spool 10 axially against the loading in the spring 17. This movement closes the orifice 16 to isolate the chamber 23 from tank 46.

Figure 4:
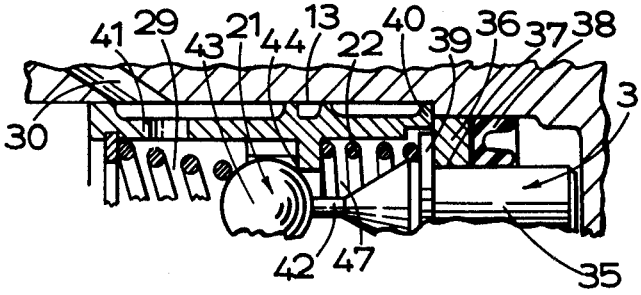
FIG. 4 is similar to FIG. 3 with the valve member unseated.
Figure 5:
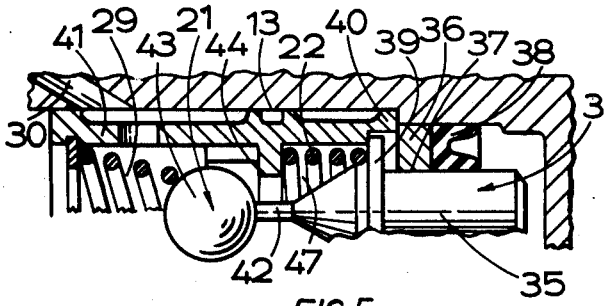
FIG. 5 is similar to FIGS. 3 and 4 but with the second valve fully open.

As the pressure in the accumulator 45 continues to rise, the spool 10 moves further in the same direction against the loading in the spring 17 until a cut-out pressure, say 1350 p.s.i. is attained, which is predetermined by the rate and the initial load of the spring 17. At this point the land 15 clears the orifice 16 so that the closed end of the bore 13 becomes connected to the chamber 26 through the orifice 16. The piston assembly 3 is thus subjected to the pressure in the accumulator 45 which acts on the inner and outer parts 35 and 36 to advance them together in the bore 13. This pressure builds up slowly because of the provision of the orifice 16. The probe 42 engages with, and urges the valve member 43 away from, the seating 44 so that the pressure differential acting across the valve member 43 decays (FIG. 4). After a small further movement of the piston assembly 3 in the same direction, additional movement of the outer part 36 is arrested by the stop 40, but the inner part 35 is able to open the valve 21 fully by sliding within the outer part 36 (FIG. 5). Thereafter the effective opening force applied to the valve member 43 to complete the opening movement is reduced substantially since it is then constituted by the pressure from the accumulator acting only over the area of the inner part 35.

The opening of the valve 21 is therefore operative to unload the pump. Thereafter the pump simply draws fluid from, and returns, fluid to, the tank, loaded only by its return spring 7.

Because of the effect of the orifice 16 on the speed of travel of the piston assembly 3, the pump may produce several delivery strokes before the piston assembly 3 can open the valve 21.

As the pressure to the accumulator is reduced during power service, the spool 10 will be moved progressively towards the one-way valves 20 and 21 by the spring 17 and, after a small movement, the land 15 will close the orifice 16 to isolate the control chamber 26 from the closed end of the bore 13. Fluid is then trapped in the chamber 23 and the passages 24 and 25 to prevent the piston assembly 3 from returning to its original position until a cut-in pressure is reached when the spool 10 will have returned to its original position in which the chamber 23 is again connected to the tank 46 through the space between the two lands 14 and 15, and the passage 34. The piston assembly 3 is then driven back to its original position by the spring 22 and the valve 21 closes.

In a modified construction the pump may be separate from the control valve 2, for example as disclosed in our G.B. patent application No. 2037016A. In such a construction the spring 22 may be omitted.

I claim:

1. An hydraulic system comprising a tank for hydraulic fluid, an hydraulic accumulator, an hydraulic pump for drawing fluid from said tank and having an output to supply fluid under pressure to charge said accumulator, and an unloader valve disposed in a supply line between said pump and said accumulator and which is operative to prevent said accumulator from being overcharged and to allow said pump to re-charge said accumulator should the pressure stored therein fall below a desired minimum value, said unloader valve comprising a housing incorporating an inlet for connection to said pump, an exhaust port for connection to said tank, a control valve, a pressure responsive slave which is operated by fluid pressure under the control of said control valve, a first one-way valve having an inlet, a second valve connected between said inlet of said first one-way valve and said exhaust port and having a valve member, and a complementary seating with which said valve member is engageable, and means defining a control chamber, said control valve comprising a control valve member movable between a first position in which said accumulator is isolated from said slave so that pump pressure can be supplied to said accumulator and a second position in which fluid pressure from said accumulator or said pump can act on said slave to render said slave operative to unload said pump, and spring means for biassing said control valve member into said first position against the control pressure present in said control chamber into which fluid is adapted to be pumped through said first one-way valve, said slave being arranged to open said second valve at a cut-out point so that said output of said pump is returned directly to said tank, and said slave comprising a piston assembly comprising inner and outer concentric piston parts which are relatively movable axially and of which said inner part is engageable with said valve member of said second valve to urge said valve member away from said seating at said cut-out point and said outer piston part is engageable with said inner piston part in a direction to open said second valve, in combination with a stop for arresting movement of said outer piston part in a direction towards said second valve after said valve member has been moved away from said seating, whereafter said inner piston part is movable relative to said outer piston part to urge said valve member further away from said seating.

2. An hydraulic system as claimed in claim 1, wherein a bore of stepped outline having a portion of greater area and a portion of smaller area is provided in said housing to accommodate said first and second valves and said piston assembly, said first and second valves being accommodated in said portion of said bore of greater area and said piston assembly working in said portion of said bore of smaller area.

3. An hydraulic system as claimed in claim 2, wherein said piston assembly is provided with an annular seal, and said outer piston part works in said portion of said bore of smaller area and is provided with a bore in which works said inner piston part, said annular seal providing a seal between said outer piston part and said portion of said bore of smaller area and between said outer piston part and said inner piston part.

4. An hydraulic system as claimed in claim 1, wherein said unloader valve incorporates a casing for said second valve having an abutment face, said abutment face comprising said stop for arresting movement of said outer piston part.

5. An hydraulic system as claimed in claim 1, wherein a return spring is provided to act on said piston assembly to urge said inner and outer piston parts into a retracted position away from said valve member.

6. An hydraulic system as claimed in claim 5, wherein said inner piston part has a terminal portion adjacent to said second valve member, said terminal portion comprising a probe of reduced diameter, said probe being positioned at a smaller distance away from said valve member than said outer piston part is away from said stop when said inner and outer piston parts are in said retracted position.

* * * * *